United States Patent [19]

Clark

[11] Patent Number: 4,909,962

[45] Date of Patent: Mar. 20, 1990

[54] LAUNDRY PRE-SPOTTER COMP. PROVIDING IMPROVED OILY SOIL REMOVAL

[75] Inventor: David D. Clark, Piscataway, N.J.

[73] Assignee: Colgate-Palmolive Co., Piscataway, N.J.

[21] Appl. No.: 338,388

[22] Filed: Apr. 13, 1989

Related U.S. Application Data

[63] Continuation of Ser. No. 115,572, Oct. 2, 1987, abandoned, which is a continuation of Ser. No. 902,716, Sep. 2, 1986, abandoned.

[51] Int. Cl.[4] ..... C11D 1/75; C11D 1/722; C11D 3/43

[52] U.S. Cl. ..... 252/547; 252/153; 252/170; 252/171; 252/174.21; 252/174.22; 252/DIG. 14

[58] Field of Search ..... 252/153, 160, 170, 171, 252/174.21, 174.22, 547, DIG. 14

[56] References Cited

U.S. PATENT DOCUMENTS

| | | | |
|---|---|---|---|
| 2,697,075 | 12/1954 | Echols | 252/170 |
| 4,178,262 | 12/1979 | Compton et al. | 252/162 |
| 4,180,472 | 12/1979 | Mitchell et al. | 252/162 |
| 4,199,482 | 4/1980 | Renaud et al. | 252/559 |
| 4,225,471 | 9/1980 | Claus et al. | 252/559 |
| 4,362,638 | 12/1982 | Caskey et al. | 252/90 |
| 4,390,466 | 6/1983 | Weinberger | 252/548 |
| 4,438,009 | 3/1984 | Brusky et al. | 252/90 |
| 4,446,044 | 5/1984 | Rutkiewic et al. | 252/170 |
| 4,530,781 | 7/1985 | Gipp | 252/546 |
| 4,801,544 | 1/1989 | Munk | 435/188 |

FOREIGN PATENT DOCUMENTS 1518676 7/1978 United Kingdom .

*Primary Examiner*—Prince E. Willis

*Attorney, Agent, or Firm*—Bernard Lieberman; Murray M. Grill; Robert C. Sullivan

[57] ABSTRACT

A clear, single phase, pre-spotting composition is provided in the form of a microemulsion, solution, or gel and which comprises, by weight:

(a) from about 10 to 70% of an organic solvent comprising one or more alkanes having from 10 to 18 carbon atoms;

(b) from about 4 to 60% of one or more nonionic surfactants comprising the condensation product of an aliphatic primary or secondary alcohol having from 9 to 16 carbon atoms with from 1 to 7 moles of ethylene oxide per mole of said alcohol;

(c) from about 0 to 50% of a supplementary nonionic surfactant comprising an amine oxide or an alkyl phenol ethoxylate, the total amount of nonionic surfactants in the pre-spotting composition being no greater than about 60%;

(d) from about 0 to 20%, of a co-surfactant comprising an aliphatic primary or secondary alcohol having from 10 to 18 carbon atoms;

(e) from about 0 to 10% of a polar organic co-solvent;

(f) from about 1 to 80% water, the respective percentages of each component of the composition being such as to form a clear, single-phase pre-spotting composition which is further characterized by being infinitely dilutable with water without concomitant phase separation such that the addition of water to said pre-spotting composition is an amount of at least one hundred parts water to one part of said composition results in a diluted composition which is entirely in a clear single phase; and (g) the balance optionally comprising a minor amount of adjuvants.

16 Claims, No Drawings

LAUNDRY PRE-SPOTTER COMP. PROVIDING IMPROVED OILY SOIL REMOVAL

This application is a continuation of application Ser. No. 115,572, filed 10/2/87 which is a continuation of U.S. patent application Ser. No. 902,716; filed 9/2/86 both abandoned.

BACKGROUND OF THE INVENTION

This invention relates to laundry pre-spotting compositions which are in the form of clear, stable, microemulsions, solutions or gels and which are suitable for the treatment of heavily soiled areas of fabrics. More particularly, the invention relates to single-phase pre-spotting compositions which are especially effective for the removal of oily stains and soils from fabrics and which are characterized by being "infinitely dilutable" with water, as herein defined, without concomitant phase separation. Thus, the removal of oily stains and soils is effected by the application of the pre-spotting composition to the generally soiled areas of the fabric which solubilizes the oily soil, followed by rinsing with water in a wash or rinse bath wherein the diluted pre-spotting compositions remains in a clear, single-phase, avoiding the attendant problem of redeposition of the oily soil on the previously cleaned fabric.

The removal of oily soils and stains from fabrics has been the focus of much attention in the laundry art. In particular, emphasis has been placed on pre-treating or pre-spotting articles of laundry which are not uniformly soiled, such as for example, shirt collars and cuffs, as a preliminary stain-removal treatment prior to regular washing. The detergent compositions which have been used and disclosed for pre-spotting have varied considerably encompassing, for example, commercial liquid laundry detergent compositions which are applied to the fabric as a pre-spotter prior to being added to the wash bath, as well as formulations intended specifically for oily soil removal which contain one or more organic solvents. While the use of aqueous liquid laundry detergents has proven successful for cleaning a wide variety of soils, the removal of oily soils, in particular, is often troublesome insofar as such liquid compositions do not generally contain a solvent especially suited for oil solubilization, such as an organic solvent. On the other hand, the known compositions which are specifically formulated for oily soil removal suffer from the fact that they are either impractical to use, or they do not avoid the problem of oily soil redeposition on the fabric in the wash or rinse bath.

The redeposition of oily soil is a problem attributable, in part, to phase separation of the pre-spotting composition containing an organic solvent when such composition becomes "infinitely" or extremely diluted with water in the wash bath. In effect, the solubilized oily soil as well as the organic solvent itself become soils to be removed from the fabric when phase separation of the pre-spotting composition occurs upon dilution. In this regard, the term "infinite dilutability" which is used herein to characterize the pre-spotting compositions of the present invention refers to the fact that the pre-spotting compositions are formulated such that when diluted with water in a ratio of at least 100 parts water to 1 part of composition, they are entirely in a clear single phase with no phase separation being present. This degree of dilutability is significant because it corresponds approximately to the dilution encountered by a pre-spotting composition when applied to a fabric which is subsequently rinsed with water, such dilution being about one hundred to one thousand-fold.

U.S. Pat. No. 4,180,472 to Mitchell et al is illustrative of a pre-treatment composition for oily stain removal which requires a multiple step operation. The patent describes a composition comprising a solvent such as an alkane in combination with a specified surfactant as an emulsifier. The described composition cannot be applied directly to the soiled fabrics, but rather, is added to the wash bath containing the items to be laundered. After oil solubilization from the soiled fabrics is effected, removal of the solvent must be carried out in a second step using a specified surfactant as a solvent stripping agent. No single-phase composition is contemplated or disclosed.

U.S. Pat. Nos. 4,093,418 and 4,178,262 to Compton et al describe laundry spot-agent compositions containing a solution of a nonionic surfactant and an isoparaffinic solvent. No water is present in the composition nor is there any indication that such compositions can be readily removed from fabrics by immersion in a wash or rinse bath without the occurence of phase separation.

British patent specification No. 1,518,676, published Jul. 19, 1978 discloses a detergent composition comprising a nonionic detergent, an organic solvent, such as, methyl laurate, and water. The percentage of organic solvent in such composition is severely restricted, however, because according to the disclosure the solvent "tends to act as a load upon the general cleaning performance of the composition". This indicates that the solvent does not remain in solution in the wash bath, but rather, is separated out and acts as a soil. In example 2 of the publication, the amount of organic solvent in the disclosed composition is 3.4%. Further, the disclosed compositions which appear to be in granular form are added directly to the wash bath, according to the examples, rather than being conveniently applied to the soiled fabrics as a pre-spotting composition.

Accordingly there remains a need in the art to provide an improved composition for oily soil removal which can be applied directly to soiled fabrics as a pre-spotter and which can be readily removed therefrom by rinsing with water.

SUMMARY OF THE INVENTION

The present invention provides a clear, single phase, liquid microemulsion, solution, or gel laundry pre-spotting composition comprising, by weight:

(a) from about 10 to 70% of an organic solvent comprising one or more alkanes having from 10 to 18 carbon atoms;

(b) from about 4 to 60% of one or more nonionic surfactants comprising the condensation product of an aliphatic primary or secondary alcohol having from 9 to 16 carbon atoms with from 1 to 7 moles of ethylene oxide per mole of said alcohol;

(c) from about 0 to 50% of a supplementary nonionic surfactant comprising an amine oxide or an alkyl phenol ethoxylate, the total amount of nonionic surfactants in the pre-spotting composition being no greater than about 60%, by weight;

(d) from about 0 to 20%, of a co-surfactant comprising an aliphatic primary or secondary alcohol having from 10 to 18 carbon atoms;

(e) from about 0 to 10% of a polar organic co-solvent;

(f) from about 1 to 80% water, the respective percentages of each component of the composition being such as to form a clear, single-phase pre-spotting composition which is further characterized by being infinitely dilutable with water without concomitant phase separation such that the addition of water to said pre-spotting composition in an amount of at least one hundred parts water to one part of said composition results in a diluted composition which is entirely in a clear single phase;

(g) the balance optionally comprising a minor amount of adjuvants.

In accordance with the process of the invention, the removal of oily soils and/or stains from fabrics with a pre-spotting composition is effected by contacting such stained fabrics, generally in the immediate area of the oily soil, with an effective amount of the above-identified liquid or gel pre-spotting composition. This treatment can then be followed by regular washing, if desired, or the treated fabrics can then be simply rinsed with an aqueous liquid, preferably water, to remove the pre-spotting composition containing the solubilized oil.

In addition to their utility as laundry and pre-spotting compositions, the compositions of the invention are also particularly useful for the removal of oily or greasy soil from hard surfaces such as plastic, vitreous and metal surfaces having a shiny finish. Oily and greasy soils present on such hard surfaces are readily solubilized in microemulsions, solutions or gels in accordance with the invention and hence such compositions may be effectively utilized as clear single phase all purpose cleaning compositions.

The described pre-spotting composition may be formulated as herein described to be in the form of a liquid solution, liquid microemulsion (either water-in-oil or oil-in-water type) or a gel, depending upon the relative proportions of the three principal components of the composition, namely, organic solvent, surfactant and water. For each of these particular forms, the compositions of the invention are clear at ambient room temperature, thermodynamically stable and in a single phase. Thus, compositions which are in the form of emulsions, or mixtures which are not otherwise in a single-phase, clear at ambient conditions, and thermodynamically stable, are not in accordance with the invention.

The term "microemulsions" as used herein refers to compositions containing two immiscible liquid phases: a dispersed phase (i.e. micelles) and a continous phase. The individual droplets of the dispersed phase of the microemulsion generally have an average radius less than about 1000Å, typically between about 50 to 1000 angstroms. In solution form, the dispersed or non-continuous phase is generally below 40Å average radius. When the dispersed phase has an average radius greater than about 1000Å, it is no longer a microemulsion but an emulsion which is generally turbid and thermodynamically unstable. The measurement of average radius size of the dispersed phase can be carried out using conventional light scattering techniques.

The present invention is predicated upon the discovery that pre-spotting compositions containing one or more organic solvents for oily soil removal can be formulated to satisfy two important requirements for the efficient application of a pre-spotting composition to a soiled fabric and its efficient removal therefrom while avoiding the problem of oil redeposition: (1) the pre-spotting composition is in the form of a clear, single-phase composition so as to allow the oily soil upon the fabric to be rapidly solubilized by the pre-spotting composition; and (2) the pre-spotting composition is readily removable from the cleaned fabric by rinsing with water without phase separation occuring in the diluted pre-spotting composition. This latter characteristic of the composition is referred to as infinite dilutability with water. More specifically, a composition is considered infinitely dilutable when it can be diluted at least one hundred-fold by weight with water to form a diluted composition which is entirely in a clear, single-phase. Accordingly, an essential characteristic of the present pre-spotting compositions is that such compositions regardless of whether in the form of a solution, microemulsion or gel, as well as the infinitely diluted compositions derived therefrom, are formed entirely of a clear, single phase.

Although the applicant does not wish to be bound to any particular theory of operation, it is believed that a condition of infinite dilution, the diluted pre-spotting compositions of the invention are in the form of an oil-in-water microemulsion. In such microemulsion, the oil (e.g. organic solvent) is the dispersed phase and is suspended in water which is the continous phase thereby removing the organic solvent and solubilized oil from contact with the treated fabric. This allows the pre-spotting compositions to be readily removed from the treated fabric by rinsing with water without the accompanying problem of phase separation and oily soil redeposition on the fabric. The formation of an oil-in-water microemulsion at infinite dilution is thus a characteristic of the presently described pre-spotting compositions.

It can be readily determined for purposes of the invention whether a particular pre-spotting formulation is infinitely dilutable in accordance with the following test: to one part of the pre-spotting formulation there is added 100 parts or more of water while stirring, both the water and the formulation being at room temperature. The resulting diluted mixture is then allowed to stand for at least one hour and then observed for phase separation. If no phase separation is present either as a clear phase boundary or by the appearance of cloudiness or opacity, the composition is considered infinitely dilutable.

DETAILED DESCRIPTION OF THE INVENTION

The pre-spotting compositions of the invention are essentially comprised of three components: organic solvent, nonionic surfactant and water. In addition to these components, there may also be present, if desired, a co-solvent, a co-surfactant, a supplementary nonionic surfactant as hereinafter defined and adjuvants. The particular components employed and their relative amounts in the pre-spotting composition is determined on the basis of such composition being in a clear-single phase and forming either a microemulsion (oil-in-water or water-in-oil), a solution (water-in-oil type i.e. oil is the continuous phase) or gel, and such composition having the further characteristic of being infinitely dilutable with water. The determination of whether a composition is infinitely dilutable with water is easily carried out in accordance with the test defined above and therefore the formulation of compositions which possess this characteristic is readily arrived at by a simple trial and error technique.

The amount of organic solvent in the composition may vary from 10 to 70%, preferably from about 60 to 80% and most preferably from about 45 to 50%, by weight of the total pre-spotting composition. The organic solvent may be comprised of one or more alkanes, straight chain or branched, having from 10 to 18 carbon atoms. Normal dodecane is a preferred solvent for the present pre-spotting composition, with n-decane, n-tridecane and n-hexadecane being also particularly useful.

A polar organic co-solvent may optionally be added to the composition in an amount of up to about 10%, by weight. Among the useful polar co-solvents are the following: low molecular weight alcohols, such as isopropanol and hexanol; benzyl alcohol; oxoalcohol esters, such as the TM Exxates (sold by Exxon); Butyl Carbitol (sold by Union Carbide Corporation); ketones, such as benzophenone; diglyme; dialkyl phthalate esters, such as dibutyl phthalte; esters of monohydric alcohols and fatty acids; esters of glycols and fatty acids; esters of glycerol and fatty acids; and esters of polyglycols and fatty acids.

The nonionic surfactant is preferably comprised of one or a mixture of primary alcohol ethoxylates or secondary alcohol ethoxylates. The primary alcohols ethoxylates are represented by the general formula:

$$R—O—(CH_2—CH_2—O)n—H$$

wherein R is an alkyl radical having from 9 to 16 carbon atoms and the number of ethoxylate groups, n, is from 1 to 7. Commerically available nonionic surfactants of this type are sold by Shell Chemical Company under the tradename Neodol and by Union Carbide Corporation under the tradename Tergitol. Especially preferred for use herein are the following: Tergitol 24-L-5, Neodol 91-6, Neodol 45-2.25, and Neodol 45-1, the latter, for example, being a $C_{14}$–$C_{15}$ alcohol condensed with 1 mole of ethylene oxide per mole of alcohol.

The secondary alcohol ethoxylates are represented by the general formula:

$$CH_3—(CH_2)_X—\underset{\underset{(CH_2—CH_2—O)_n—H}{|}}{\overset{\overset{O}{|}}{CH}}—(CH_2)_Y—CH_3$$

wherein X+Y is from 6 to 13 and the number of ethoxylate groups, n, is from 1 to 7. Commercially available surfactants of this type are sold by Union Carbide Corporation under the tradename Tergitol S series surfactants.

The nonionic surfactant or mixture of surfactants which are useful for the present compositions have an HLB (hydrophilic-lypophilic balance) of from about 9 to 13, preferably from about 9 to 11, and most preferably from about 9.5 to 10.5. Generally, if the surfactant or surfactant mixture in the composition has an HLB higher than about 12, an oil-soluble fatty alcohol co-surfactant (e.g. a $C_{14}/C_{15}$ alcohol) or a water and oil miscible polar organic cosolvent is required in the composition such as, isopropanol, hexanol or Butyl Carbitol.

In suitable circumstances, other nonionic surfactants can be present in partial replacement or supplementary to the above-defined alcohol ethoxylated surfactants. These supplementary surfactants are comprised principally of two types of nonionic surfactants: amine oxides and alkyl phenol ethoxylates.

The useful amine oxides are represented by the general formula:

$$R_1—\overset{\overset{R_2}{|}}{\underset{\underset{R_3}{|}}{N}}\longrightarrow O$$

wherein $R_1$ is an alkyl radical containing from 12 to 18 carbon atoms, and $R_2$ and $R_3$ are methyl, ethyl or hydroxyethyl. Commercially available surfactants of this type are sold by Armak under the tradename Aromox surfactant, such as, for example, Aromox DMMC-W the tradename for dimethyl cocoamine oxide.

The alkyl phenol ethoxylates which may be used in the present compositions include the condensation products of alkylphenol having an alkyl group containing from about 8 to 10 carbon atoms in either a straight chain or branched chain configuration with ethylene oxide, said ethylene oxide being present in an amount of 4 to 15 moles of ethylene oxide per mole of alkyl phenol. Commercially available nonionic surfactants of this type include Tergitol NP surfactant sold by Union Carbide Corporation and Igepal surfactants sold by GAF Corporation. Particularly useful is Igepal CO-630 comprised of a $C_9$ alkyl phenol ethoxylate with 9 moles of ethylene oxide per mole of phenol.

In general, a supplementary nonionic surfactant may be advantageously used depending upon product economics, surfactant availability or to adjust the HLB of the nonionic surfactant mixture to a desired value.

The total amount of nonionic surfactant in the composition is from about 8 to 60%, preferably from about 15 to 50%, and most preferably from about 30 to 50%, by weight of the composition. The percentage of primary or secondary alcohol ethoxylate may vary from about 4 to 60% of the composition. Hence, if the level of the defined alcohol ethoxylates in the composition is below about 8%, by weight, a supplementary nonionic surfactant as herein defined must ordinarily be present in conjunction therewith. The supplementary nonionic surfactant may be present in a ratio of up to 5:1 relative to the alcohol ethoxylates, a ratio of from about 0.5:1 to 3:1 being preferred.

A co-surfactant may optionally be used in the pre-spotting compositions in an amount of up to about 20%, by weight, for purposes of lowering the HLB value of the nonionic surfactant or mixture of nonionic surfactants to the desired value. The co-surfactant is preferably comprised of a primary or secondary fatty alcohol having from 10 to 18 carbon atoms. Commercially available alcohols of this type are sold under the tradename Neodol by Shell Chemical Company. Neodol 45, a $C_{14}$–$C_{15}$ alcohol, is particularly useful as a co-surfactant in the present compositions.

The amount of water in the pre-spotting compositions may vary from about 1 to 80%, by weight, depending upon the desired form of the composition. Water-in-oil microemulsions or water-in-oil solutions are generally favored when water is present at levels of from about 1 to 15%, of the composition. Gels which are typically liquid crystalline or isotropic microemulsion gels, are generally formed when the amount of water is from about 25% to 50%, by weight. Oil-in-water microemulsions are generally favored when the water is present at levels of about 50% or higher of the total composition. When the water content is between about 15 to 25%, the resulting compositions will generally define a range of water-solvent-surfactant mixtures which are not in a single phase and hence are outside the scope of the present invention.

Various adjuvants may be present in the pre-spotting compositions, such as fluorescent brighteners, bleaches, enzymes, perfumes and colorants. The perfumes that are employed usually include essential oils, esters, aldehydes and/or alcohols, all of which are known in the perfumery art. The colorants may include dyes and water dispersible pigments of various types. The bleach is preferably hydrogen peroxide in an amount of from 0 to 3%, by weight. The enzymes may be protease or amylase enzymes or mixtures thereof. Also present may be builders, such as sodium sesquicarbonate; antiredeposition agents, such as sodium carboxymethyl-cellulose; dispersing agents, such as sodium polyacrylate; bactericides; fungicides; anti-foam agents, such as silicones; anti-soiling agents, such as copolyesters; preservatives such as formalin; and foam stabilizers.

The individual proportion of the aforementioned adjuvants will be less than 3%, by weight, often less than 1%, except for builders for which the proportion may sometimes be about 5% or higher. The total percentage of adjuvants will normally be no more than 10%, by weight, of the pre-spotting composition and desirably less than 5% thereof. It is, of course, understood that the adjuvants employed are selected so as not to interfere with the essential physical characteristics of the pre-spotting composition as well as the oily soil removal effected by such pre-spotting composition.

The pre-spotting compositions may be prepared by simple mixing the components, the amount of agitation and the order of addition of components not being critical process parameters. However, to reduce the mixing time and energy required in the manufacturing process the following orders of addition are preferred.

To form water-in-oil solutions, water-in-oil microemulsions or gels, the organic solvent and surfactant are combined followed by the addition of water. When two or more surfactants are used, the more oil soluble (i.e. hydrophobic) surfactant is combined with the solvent prior to adding the more water soluble (i.e. hydrophilic) surfactant, with water then being added to the resulting mixture.

To form oil-in-water microemulsions, the order of addition is reversed. Thus, the surfactant or surfactant mixture is first added to water followed by addition of the organic solvent. If a palar organic co-solvent is employed, it should be combined with the organic solvent prior to being added to the water - surfactant mixture. Where two or more surfactants are to be used, the more hydrophilic surfactant is first added to the water followed by addition of the more hydrophobic surfactant. If water-soluble adjuvants are to be used, they are the first components dissolved in the water before addition of the other components.

EXAMPLE 1

Illustrative of the pre-spotting compositions of the invention, Compositions 1 through 21 were prepared in accordance with the above-described method of preparation. The particular form of the pre-spotting composition is indicated for each composition described.

| | | WT. PERCENT | |
|---|---|---|---|
| 1- | n-Dodecane | 42.0 | |
| | Alcohol ($C_9$-$C_{11}$) ethoxylate (EO 6) | 42.0 | (Neodol 91-6) |
| | Alcohol ($C_{14}$-$C_{15}$) ethoxylate (EO 1) | 11.2 | (Neodol 45-1) |
| | Water | 4.8 | |
| | Form: water-in-oil solution | 100.0 | |
| 2- | n-Dodecane | 30% | |
| | Alcohol ($C_{12}$-$C_{14}$) ethoxylate (EO 5) | 30 | |
| | Water | 40 | |
| | Form: gel | 100% | |
| 3- | n-Hexadecane | 15.4% | |
| | Alcohol ($C_9$-$C_{11}$) ethoxylate (EO 6) | 9.5 | |
| | Alcohol ($C_{14}$-$C_{15}$) ethoxylate (EO 1) | 4.8 | |
| | Water | 70.3 | |
| | Form: oil-in-water (o/w) microemulsion | 100.0 | |
| 4- | n-Dodecane | 35.3% | |
| | Alcohol ($C_9$-$C_{11}$) ethoxylate (EO 6) | 37.9 | |
| | Alcohol ($C_9$-$C_{11}$) ethoxylate (EO 2.25) | 4.3 | |
| | Benzyl alcohol | 6.9 | |
| | Water | 15.6 | |
| | Form: water-in-oil (w/o) microemulsion | 100.0 | |
| 5- | n-Dodecane | 15.0% | |
| | Secondary alcohol ($C_{15}$) ethoxylate (EO 7) | 15.0 | (Tergitol 15-S-7) |
| | Alcohol ($C_{14}$-$C_{15}$) ethoxylate (EO 1) | 2.0 | |
| | Benzyl alcohol | 3.0 | |
| | Water | 65.0 | |
| | Form: o/w microemulsion | 100.0% | |
| 6- | n-Dodecane | 10.0% | |
| | Secondary alcohol ($C_{15}$) ethoxylate (EO 5) | 10.0 | |
| | Alcohol ($C_{12}$-$C_{15}$) ethoxylate (EO 3) | 2.0 | |
| | Benzyl alcohol | 2.0 | |
| | Water | 76.0 | |
| | Form: o/w microemulsion | 100.0 | |
| 7- | n-Dodecane | 24.0% | |
| | Butyl Carbitol (Union Carbide TM) | 6.0 | |
| | Alcohol ($C_{14}$-$C_{15}$) ethoxylate (EO 2.25) | 8.0 | |
| | Dimethyl cocoamine oxide | 10.0 | |
| | Water | 52.0 | |
| | Form: o/w microemulsion | 100.0 | |
| 8- | PEG 400 Distearate | 5.6% | |
| | n-Dodecane | 22.2 | |
| | Alcohol ($C_{14}$-$C_{15}$) ethoxylate (EO 2.25) | 7.4 | |
| | Dimethyl cocoamine oxide | 7.4 | |
| | Butyl carbitol | 7.4 | |
| | Water | 50.0 | |
| | Form: o/w microemulsion | 100.0 | |
| 9- | n-Dodecane | 48.0% | |
| | Alkyl ($C_9$) phenol ethoxylate (EO 9) | 30.0 | (Igepal CO-630) |
| | Alcohol ($C_{14}$-$C_{15}$) ethoxylate (EO 2.25) | 21.0 | |
| | Water | 1.0 | |
| | Form: w/o solution | 100.0 | |
| 10- | n-Dodecane | 10.0% | |
| | Alkyl ($C_9$) phenol ethoxylate (EO 9) | 5.0 | |
| | Alcohol ($C_{14}$-$C_{15}$) ethoxylate (EO 2.25) | 5.0 | |
| | Butyl carbitol | 5.7 | |
| | Water | 74.3 | |
| | Form: o/w microemulsion | 100.0 | |
| 11- | n-Dodecane | 54.0% | |
| | Alkyl ($C_9$) phenol | 30.0 | |

-continued

| | WT. PERCENT | |
|---|---|---|
| ethoxylate (EO 9) | | |
| Alcohol ($C_{14}$–$C_{15}$) ethoxylate (EO 2.25) | 14.0 | |
| Water | 2.0 | |
| Form: w/o microemulsion | 100.0 | |
| 12- n-Dodecane | 17.0% | |
| Alcohol ($C_9$–$C_{11}$) ethoxylate (EO 6) | 9.7 | |
| Alcohol ($C_{14}$–$C_{15}$) ethoxylate (EO 1) | 4.5 | |
| Water | 68.8 | |
| Form: o/w microemulsion | 100.0 | |
| 13- n-tridecane | 15.4% | |
| Alcohol ($C_9$–$C_{11}$) ethoxylate (EO 6) | 9.5 | |
| Alcohol ($C_{14}$–$C_{15}$) ethoxylate (EO 1) | 4.8 | |
| Water | 70.3 | |
| Form: o/w microemulsion | 100.0 | |
| 14- n-Hexadecane | 48.0% | |
| Alcohol ($C_9$–$C_{11}$) ethoxylate (EO 6) | 31.8 | |
| Alcohol ($C_{14}$–$C_{15}$) ethoxylate (EO 1) | 16.9 | |
| Water | 3.3 | |
| Form: w/o solution | 100.0 | |
| 15- n-Dodecane | 35.1% | |
| Alcohol ($C_9$–$C_{11}$) ethoxylate (EO 6) | 51.3 | |
| Alcohol ($C_{14}$–$C_{15}$) | 9.1 | |
| Water | 4.5 | |
| Form: w/o solution | 100.0 | |
| 16- n-Dodecane | 14.8% | |
| Oxohexyl acetate | 0.2 | |
| Alcohol ($C_9$–$C_{11}$) ethoxylate (EO 6) | 22.0 | |
| Alcohol ($C_{14}$–$C_{15}$) | 3.0 | |
| Water | 60.0 | |
| Form: o/w microemulsion | 100.0 | |
| 17- n-Dodecane | 30.0% | |
| Alcohol ($C_{12}$–$C_{14}$) ethoxylate (EO 5) | 20.0 | |
| Water | 50.0 | |
| Form: gel | 100.0 | |
| 18- n-Dodecane | 25.0% | |
| Alcohol ($C_9$–$C_{11}$) ethoxylate (EO 6) | 37.3 | |
| Alcohol ($C_{14}$–$C_{15}$) | 5.1 | (Neodol 45) |
| Oxyhexyl acetate | 0.4 | |
| Water | 32.2 | |
| Form: gel | 100.0 | |
| 19- n-Decane | 40.9% | |
| Alcohol ($C_9$–$C_{11}$) ethoxylate (EO 6) | 23.6 | |
| Alcohol ($C_{14}$–$C_{15}$) ethoxylate (EO 1) | 11.0 | |
| Water | 24.5 | |
| Form: gel | 100.0 | |
| 20- n-Dodecane | 10.0% | |
| Alcohol ($C_{12}$–$C_{14}$) ethoxylate (EO 5) | 10.0 | |
| Water | 80.0 | |
| Form: oil-in-water microemulsion | 100.0 | |
| 21- n-Dodecane | 45.0% | |
| Alcohol ($C_{12}$–$C_{14}$) ethoxylate (EO 5) | 45.0 | |
| Water | 10.0 | |
| Form: water-in-oil microemulsion | 100.0 | |

(a) the names in parantheses represent the commercial tradenames of the alcohol ethoxylates marketed by Shell Chemical Company used in the composition. Neodol 91-6, for example, is an ethoxylated alcohol having from 9 to 11 carbons atoms with 6 moles of ethylene oxide per mole of alcohol.

EXAMPLE 2

Compositions 22–24 described below are illustrative of formulations which were all in the form of clear single-phase solutions yet were not infinitely dilutable as herein defined, and hence are not in accordance with the invention.

| | WT. PERCENT |
|---|---|
| 22- n-Dodecane | 58.8% |
| Alcohol ($C_{12}$–$C_{14}$) ethoxylate (EO 5) | 39.2 |
| Water 2.0 | |
| Form: w/o solution | 100.0 |
| 23- n-Tridecane (Norpar 13) | 50.0% |
| Alcohol ($C_9$–$C_{11}$) ethoxylate (EO 6) | 22.2 |
| Alcohol ($C_{14}$–$C_{15}$) ethoxylate (EO 2.25) | 17.8 |
| Water | 10.0 |
| Form: w/o solution | 100.0 |
| 24- n-Tridecane | 40.0% |
| Alcohol ($C_9$–$C_{11}$) ethoxylate (EO 6) | 27.8 |
| Alcohol ($C_9$–$C_{11}$) ethoxylate (EO 1) | 22.2 |
| Water | 10.0 |
| Form: w/o solution | 100.0 |

EXAMPLE 3

Shown below is composition 25, similar to compositions 23 and 24 but significantly different insofar as it is formulated to be infinitely dilutable and hence in accord with the invention.

| | WT. PERCENT |
|---|---|
| 25- n-Tridecane | 45.0% |
| Alcohol ($C_9$–$C_{11}$) ethoxylate (EO 6) | 25.0 |
| Alcohol ($C_{14}$–$C_{15}$) ethoxylate (EO 2.25) | 20.0 |
| Water | 10.0 |
| Form: w/o solution | 100.00 |

EXAMPLE 4

The following procedure was followed in evaluating the efficacy of pre-spotting compositions in accordance with the invention relative to the performance of commercial liquid compositions intended for oily soil removal.

The stained swatches to be cleaned were 3"×4" and consisted of the following:

1. Dirty motor oil on Dacron doublenit (DMO);
2. Barbecue sauce on Dacron double knit (BBQ);
3. Carbon black in olive oil on cotton percale (EMPA); and
4. Artificial sebum/particulate on a blend of 65% Dacron/35% cotton (SEBUM).

An initial reflectance reading (Rd initial) of the stained swatches was recorded. A duplicate of each stained swatch was used in the test. To each swatch there was applied 0.2 gram of the particular pre-spotting fluid which was then allowed to soak for four (4) minutes. The treated swatches were then added to a Tergotometer vessel with each bucket thereof containing the stained swatches to be tested in duplicate (a total of 8 stained swatches) for a particular pre-spotting composition. Each bucket of the Tergotometer contained one liter of water having dissolved therein 0.3 grams of a commercial powder laundry detergent composition, the water hardness being 150 ppm of artificial hardness as calcium carbonate. After adding the treated stained swatches to the wash liquor, the swatches were washed for 12 minutes at 100° F. while agitated at 100 rpm. The wash liquor was then discarded and replaced with one liter of water at 100° F. containing 150 ppm of artifical hardness. The swatches were then rinsed for 5 minutes at 100 rpm, removed from the rinse water and allowed to air dry. The reflectance reading of each of the washed swatches (Rd final) was then recorded.

The percent soil removal (% SR) was calculated using the following equation:

$$\%SR = \frac{Rd\ \text{final} - Rd\ \text{initial}}{92 - Rd\ \text{initial}} \times 100$$

An oil-in-water microemulsion (Composition A) and a water-in-oil solution (Composition B), compositions in accordance with the invention, were formulated as shown below:

| COMPOSITION A | WT. PERCENT |
|---|---|
| n-Dodecane | 15% |
| Alcohol ($C_9$-$C_{11}$) ethoxylate (EO 6) | 15 |
| Alcohol ($C_{14}$-$C_{15}$) ethoxylate (EO 1) | 4 |
| Water | 66 |
| Form: o/w microemulsion | 100.0 |

| COMPOSITION B | WT. PERCENT |
|---|---|
| n-Dodecane | 44.0% |
| Alcohol ($C_9$-$C_{11}$) ethoxylate (EO 6) | 44.0 |
| Alcohol ($C_{14}$-$C_{15}$) ethoxylate (EO 1) | 11.0 |
| Water | 1.0 |
| Form: w/o solution | 100.0 |

Compositions A and B were evaluated for soil removal in accordance with the procedure described above as were the following four commercial formulations: a pre-spotter; a liquid laundry detergent composition; a pine oil-based liquid cleaner containing about 30% pine oil; and a petroleum-based all purpose cleaner containing about 40% petroleum distillates. The results of the soil removal tests are shown below indicating the % SR achieved for each composition. A difference of about 5% SR units is considered to be the minimum that can be visually detected in a side-by-side comparison of two fabrics.

| | % SR | | | |
|---|---|---|---|---|
| Prespotter | DMO | BBQ | EMPA | SEBUM |
| Composition A (o/w microemulsion) | 8.2 | 55.9 | 30.1 | 73.4 |
| Composition B (w/o solution) | 42.2 | 57.5 | 50.2 | 68.1 |
| Prespotter | 7.3 | 39.6 | 49.0 | 63.5 |
| Liquid laundry detergent | 5.1 | 49.7 | 37.6 | 72.3 |
| Pine oil-based cleaner | 9.8 | 63.6 | 55.3 | 66.5 |

-continued

| | % SR | | | |
|---|---|---|---|---|
| Prespotter | DMO | BBQ | EMPA | SEBUM |
| Petroleum-based cleaner | 15.9 | 61.3 | 52.9 | 67.1 |

As shown in the Table, the solution form of the present pre-spotting compositions (Composition B) was markedly superior in performance relative to all four of the commercial pre-spotting and cleaning compositions. This was most evident with regard to removal of the DMO stain. The o/w microemulsion composition (Composition A) was essentially equivalent in performance to the commercial pre-spotter and liquid laundry detergent but slightly inferior overall to the pine oil-based cleaner and the petroleum-based cleaner. The latter cleaners however are more susceptible to problems of redeposition of the organic solvent, particularly at higher temperatures, such as above 100° F.

EXAMPLE 5

The procedure of Example 4 was followed to evaluate Composition C, a water-in-soil solution in accordance with the invention, relative to a commercial liquid pre-spotting composition and a commercial liquid laundry detergent. Tap water at 114° F. was used in place of 100° F. water containing 150 ppm hardness. The stains tested were DMO, BBQ and EMPA as previously described.

Composition C was comprised of the following:

| COMPOSITION C | WT. PERCENT |
|---|---|
| n-Dodecane | 48.2% |
| Oxohexyl alcohol | 0.8 |
| Alcohol ($C_9$-$C_{11}$) ethoxylate (EO 6) | 34.2 |
| Alcohol ($C_{14}$-$C_{15}$) ethoxylate (EO 1) | 14.8 |
| Water | 2.0 |
| Form: w/o solution | 100.0 |

The results of the cleaning tests are shown below:

| | % SR | | |
|---|---|---|---|
| Pre-Spotter | DMO | BBQ | EMPA |
| Composition C | 30.1 | 66.1 | 42.1 |
| Commercial pre-spotter | 6.4 | 41.5 | 37.5 |
| Liquid laundry detergent | 3.2 | 47.0 | 35.6 |

As shown in the Table above, Composition C was markedly superior as a pre-spotting composition relative to the commercial compositions.

What is claimed is:

1. A clear, single phase, liquid microemulsion, solution, or gel laundry pre-spotting composition comprising, by weight:

(a) from about 10 to 70% of an organic solvent comprising one or more alkanes having from 10 to 18 carbon atoms;

(b) from about 4 to 60% of one or more nonionic surfactants comprising the condensation product of an aliphatic primary or secondary alcohol having from 9 to 16 carbon atoms with from 1 to 7 moles of ethylene oxide per mole of said alcohol;

(c) from about 0 to 50% of a supplementary nonionic surfactant comprising an amine oxide or an alkyl phenol ethoxylate, the total amount of nonionic surfactants in the pre-spotting composition being no greater than about 60%, by weight;

(d) from about 0 to 20%, of a co-surfactant comprising an aliphatic primary or secondary alcohol having from 10 to 18 carbon atoms;

(e) from about 0 to 10% of a polar organic co-solvent; and (f) from about 1 to 80% water, the respective percentages of each component of the composition being such as to form a clear, single-phase pre-spotting composition which is further characterized by being infinitely dilutable with water without concomitant phase separation such that the addition of water to said pre-spotting composition in an amount of at least one hundred parts water to one part of said composition results in a diluted composition which is entirely in a clear single phase.

2. A pre-spotting composition according to claim 1 wherein the amount of water is from about 1 to 15%, by weight of the composition.

3. A pre-spotting composition according to claim 1 wherein the organic solvent is n-dodecane.

4. A pre-spotting composition according to claim 1 wherein the nonionic surfactant is the condensation product of a primary alcohol having from 12 to 14 carbon atoms with five mole of ethylene oxide per mole of said alcohol, and wherein said pre-spotting composition is substantially free of said co-surfactant.

5. A pre-spotting composition according to claim 1 wherein the HLB value of the nonionic surfactant or surfactant mixture in the pre-spotting composition is from about 9 to 11.

6. A pre-spotting composition according to claim 1 which contains a supplementary nonionic surfactant comprised of an alkyl phenol ethoxylate.

7. A pre-spotting composition according to claim 1 which contains a supplementary nonionic surfactant comprised of an amine oxide.

8. A pre-spotting composition according to claim 1 in the form of a water-in-oil solution comprising, by weight, about 45% tridecane; about 29.2% of a primary alcohol ethoxylate wherein the alcohol has from about 9 to 11 carbon atoms and is condensed with 6 moles of ethylene oxide per mole of alcohol; about 15.8% of a primary alcohol ethoxylate wherein the alcohol has from about 14 to 15 carbon atoms and is condensed with 2.25 moles of ethylene oxide per mole of alcohol; and about 10% water.

9. A process of spotting and laundering fabrics containing an oily soil and/or stain comprising:

(1) contacting the soiled fabrics with an effective amount of a clear, single-phase, liquid microemulsion, solution, or gel laundry pre-spotting composition which comprises, by weight:

(a) from about 10 to 70% of an organic solvent comprising one or more alkanes having from 10 to 18 carbon atoms;

(b) from about 4 to 60% of one or more monionic surfactants comprising the condensation product of an aliphatic primary or secondary alcohol having from 9 to 16 carbon atoms with from 1 to 7 moles of ethylene oxide per mole of said alcohol; ethylene (c) from about 0 to 50% of a supplementary nonionic surfactant comprising an amine oxide or an alkyl phenol ethoxylate, the total amount of nonionic surfactants in the pre-spotting composition being no greater than about 60%;

(d) from about 0 to 20%, of a co-surfactant comprising an aliphatic primary or secondary alcohol having from 10 to 18 carbon atoms;

(e) from about 0 to 10% of a polar organic co-solvent;

(f) from about 1 to 80% water, the respective percentage of each component of the composition being such as to form a clear, single-phase pre-spotting composition which is further characterized by being infinitely dilutable with water without concomitant phase separation such that the addition of water to said pre-spotting composition in an amount of at least one hundred parts water to one part of said composition results in a diluted composition which is entirely in a clear single phase; and (g) the balance optionally comprising a minor amount of adjuvants; and (2) rinsing the fabrics treated in step (1) with an aqueous liquid so as to remove the pre-spotting composition from said fabrics and thereby recovering the laundered fabrics substantially free of said oily soils and/or stains.

10. A process according to claim 9 wherein said pre-spotting composition contains from about 1 to 15%, by weight, water.

11. A process according to claim 9 wherein the organic solvent in said pre-spotting composition is n-dodecane.

12. A process according to claim 9 wherein the nonionic surfactant in said pre-spotting composition is the condensation product of a primary alcohol having from 12 to 14 carbon atoms with five mole of ethylene oxide per mole of said alcohol, and wherein said pre-spotting composition is substantially free of said co-surfactant.

13. A process according to claim 9 wherein the HLB value of the nonionic surfactant or surfactant mixture in said pre-spotting composition is from about 9 to 11.

14. A process according to claim 9 wherein the pre-spotting composition contains a supplementary nonionic surfactant comprised of an alkyl phenol ethoxylate.

15. A process according to claim 9 wherein the pre-spotting composition contains a supplementary nonionic surfactant comprised of an amine oxide.

16. A process according to claim 9 wherein the pre-spotting composition is in the form of a water-in-oil solution comprising, by weight, about 45% tridecane; about 29.2% of a primary alcohol ethoxylate wherein the alcohol has from about 9 to 11 carbon atoms and is condensed with 6 moles of ethylene oxide per mole of alcohol; about 15.8% of an alcohol ethoxylate wherein the alcohol has from about 14 to 15 carbon atoms and is condensed with 2.25 moles of ethylene oxide per mole of alcohol; and about 10% water.

* * * * *